US008958974B2

(12) United States Patent
Makki et al.

(10) Patent No.: US 8,958,974 B2
(45) Date of Patent: Feb. 17, 2015

(54) NON-INTRUSIVE EXHAUST GAS SENSOR MONITORING

(75) Inventors: Imad Hassan Makki, Dearborn Heights, MI (US); James Michael Kerns, Trenton, MI (US); Michael Casedy, Ann Arbor, MI (US); Hassene Jammoussi, Houston, TX (US)

(73) Assignee: Ford Global Technologies, LLC, Dearborn, MI (US)

( * ) Notice: Subject to any disclaimer, the term of this patent is extended or adjusted under 35 U.S.C. 154(b) by 627 days.

(21) Appl. No.: 13/352,931

(22) Filed: Jan. 18, 2012

(65) Prior Publication Data

US 2013/0180510 A1 Jul. 18, 2013

(51) Int. Cl.
*F02D 41/14* (2006.01)

(52) U.S. Cl.
USPC ..... 701/109; 701/114; 123/688; 123/690; 123/703; 73/114.73

(58) Field of Classification Search
USPC ..... 701/103, 109, 114; 123/688, 690, 703; 73/114.73
See application file for complete search history.

(56) References Cited

U.S. PATENT DOCUMENTS

| | | | | |
|---|---|---|---|---|
| 5,335,643 | A * | 8/1994 | Abate et al. | 123/679 |
| 6,564,141 | B2 * | 5/2003 | Weisman, II | 701/102 |
| 7,006,909 | B1 | 2/2006 | May | |
| 2009/0112441 | A1 | 4/2009 | Perschl et al. | |
| 2011/0132341 | A1 | 6/2011 | Magner et al. | |

OTHER PUBLICATIONS

Makki, Imad Hassan et al., "Non-Intrusve Exhaust Gas Sensor Monitoring," U.S. Appl. No. 13/352,885, filed Jan. 18, 2012, 39 pages.

* cited by examiner

*Primary Examiner* — Erick Solis
(74) *Attorney, Agent, or Firm* — Julia Voutyras; Alleman Hall McCoy Russell & Tuttle LLP

(57) ABSTRACT

A method of monitoring an exhaust gas sensor coupled in an engine exhaust is provided. The method comprises indicating exhaust gas sensor degradation based on a difference between a first set of estimated parameters of a rich operation model and a second set of estimated parameters of a lean operation model, the estimated parameters based on commanded lambda and determined lambda values collected during selected operating conditions. In this way, sensor degradation may be indicated with data collected in a non-intrusive manner.

20 Claims, 4 Drawing Sheets

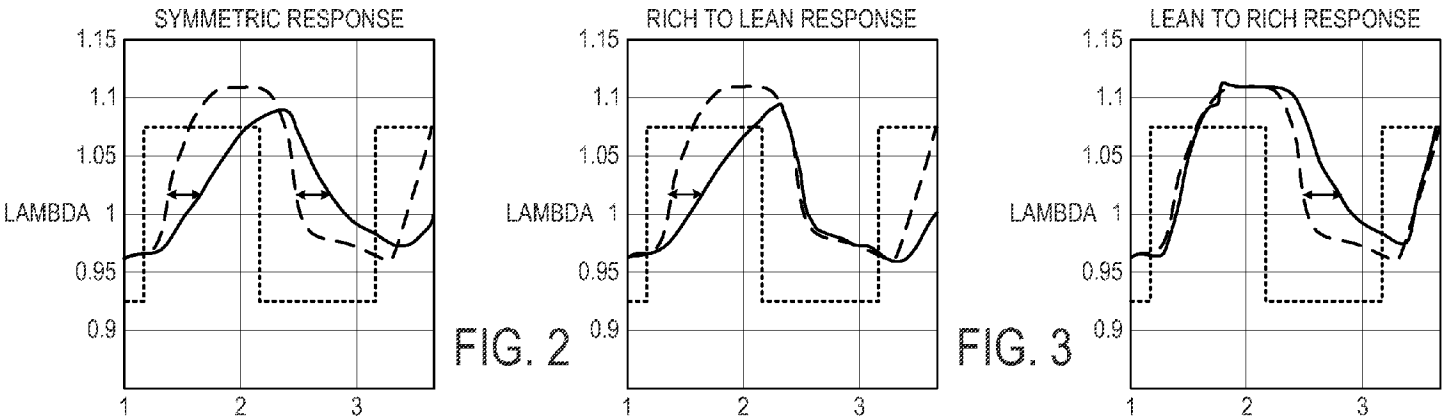
FIG. 2
FIG. 3
FIG. 4
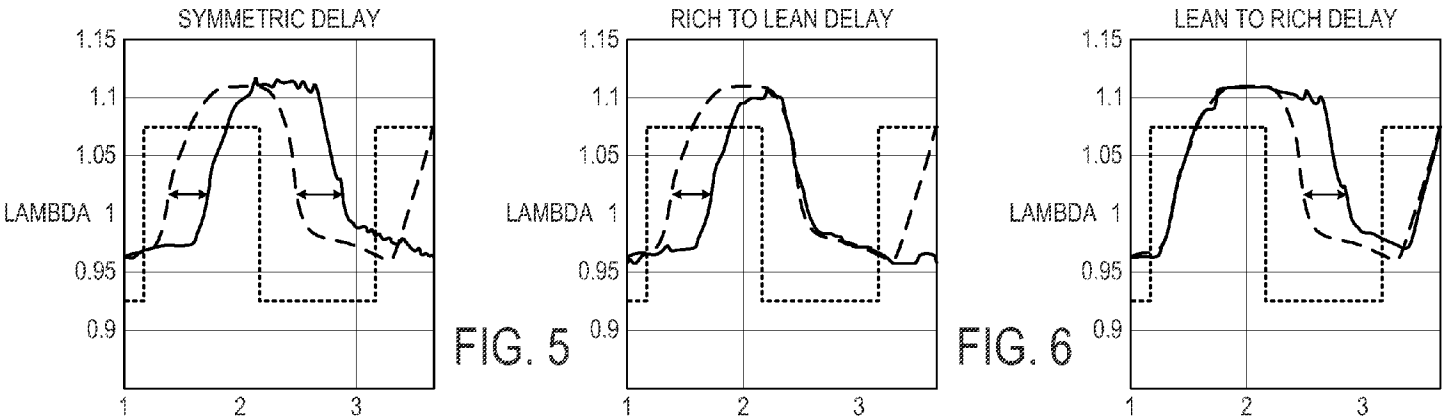
FIG. 5
FIG. 6
FIG. 7
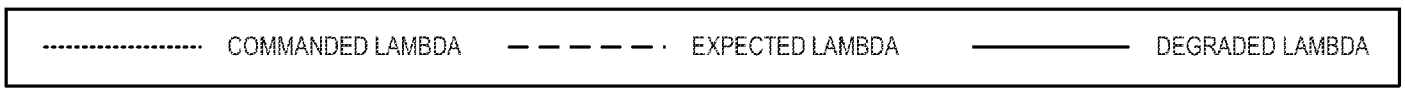

NON-INTRUSIVE EXHAUST GAS SENSOR MONITORING

FIELD

The present disclosure relates to an exhaust gas sensor in a motor vehicle.

BACKGROUND AND SUMMARY

An exhaust gas sensor may be positioned in an exhaust system of a vehicle to detect an air/fuel ratio of exhaust gas exhausted from an internal combustion engine of the vehicle. The exhaust gas sensor readings may be used to control operation of the internal combustion engine to propel the vehicle.

Degradation of an exhaust gas sensor may cause engine control degradation that may result in increased emissions and/or reduced vehicle drivability. Accordingly, accurate determination of exhaust gas sensor degradation may reduce the likelihood of engine control based on readings from a degraded exhaust gas senor. In particular, an exhaust gas sensor may exhibit six discrete types of degradation behavior. The degradation behavior types may be categorized as asymmetric type degradation (e.g., rich-to-lean asymmetric delay, lean-to-rich asymmetric delay, rich-to-lean asymmetric slow response, lean-to-rich asymmetric slow response) that affects only lean-to-rich or rich-to-lean exhaust gas sensor response rates, or symmetric type degradation (e.g., symmetric delay, symmetric slow response) that affects both lean-to-rich and rich-to-lean exhaust gas sensor response rates. The delay type degradation behaviors may be associated with the initial reaction of the exhaust gas sensor to a change in exhaust gas composition and the slow response type degradation behaviors may be associated with a duration after an initial exhaust gas sensor response to transition from a rich-to-lean or lean-to-rich exhaust gas sensor output.

Previous approaches to monitoring exhaust gas sensor degradation, particularly identifying one or more of the six degradation behaviors, have relied on intrusive data collection. That is, an engine may be purposely operated with one or more rich to lean or lean to rich transitions to monitor exhaust gas sensor response. However, these excursions may be restricted to particular operating conditions that do not occur frequently enough to accurately monitor the sensor, such as during deceleration fuel shut off conditions. Further, these excursions may increase engine operation at non-desired air/fuel ratios that result in increased fuel consumption and/or increased emissions.

The inventors herein have recognized the above issues and identified a non-intrusive approach for determining exhaust gas sensor degradation. In one embodiment, a method of monitoring an exhaust gas sensor coupled in an engine exhaust comprises indicating exhaust gas sensor degradation based on a difference between a first set of estimated parameters of a rich operation model and a second set of estimated parameters of a lean operation model, the estimated parameters based on commanded lambda and determined lambda values collected during selected operating conditions.

In this way, exhaust gas sensor degradation may be indicated by parameters estimated from two operation models, a rich combustion model and a lean combustion model. Commanded air-fuel ratio and the air-fuel ratio indicated by the exhaust gas sensor may be compared with the assumption that the combustion that generated the air-fuel ratio was rich (e.g., inputting the commanded lambda into the rich model) and also compared assuming that the combustion event was lean (e.g., inputting the commanded lambda into the lean model). For each model, a set of parameters may be estimated that best fits the commanded lambda values with the measured lambda values. The model parameters may include a time constant, time delay, and static gain of the model. The estimated parameters from each model may be compared to each other, and sensor degradation may be indicated based on differences between the estimated parameters.

By determining degradation of an exhaust gas sensor using a non-intrusive approach with data collected during selected operating conditions, exhaust gas sensor degradation monitoring may be performed in a simple manner. Further, by using the exhaust gas sensor output to determine which of the seven degradation behaviors the sensor exhibits, closed loop feedback control may be improved by tailoring engine control (e.g., fuel injection amount and/or timing) responsive to indication of the particular degradation behavior of the exhaust gas sensor to reduce the impact on vehicle drivability and/or emissions due to exhaust gas sensor degradation.

The above advantages and other advantages, and features of the present description will be readily apparent from the following Detailed Description when taken alone or in connection with the accompanying drawings.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

BRIEF DESCRIPTION OF THE DRAWINGS

FIG. 2 shows a graph indicating a symmetric response type degradation behavior of an exhaust gas sensor.

FIG. 3 shows a graph indicating an asymmetric rich-to-lean response type degradation behavior of an exhaust gas sensor.

FIG. 4 shows a graph indicating an asymmetric lean-to-rich response type degradation behavior of an exhaust gas sensor.

FIG. 5 show a graph indicating a symmetric delay type degradation behavior of an exhaust gas sensor.

FIG. 6 shows a graph indicating an asymmetric rich-to-lean delay type degradation behavior of an exhaust gas sensor.

FIG. 7 shows a graph indicating an asymmetric lean-to-rich delay type degradation behavior of an exhaust gas senor.

DETAILED DESCRIPTION

Figure 1:
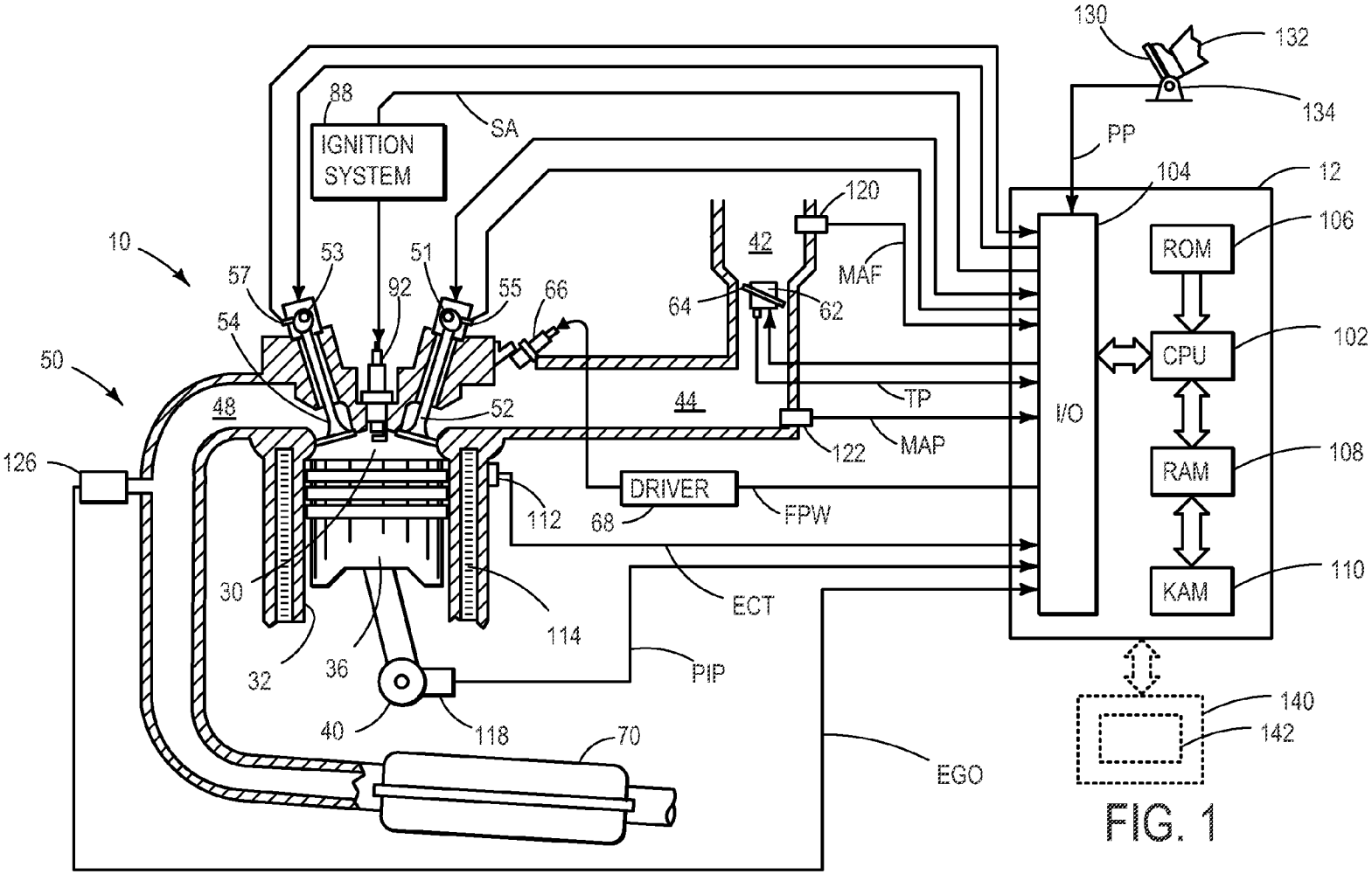
FIG. 1 shows a schematic diagram of an embodiment of a propulsion system of a vehicle including an exhaust gas sensor.
Figure 8A:
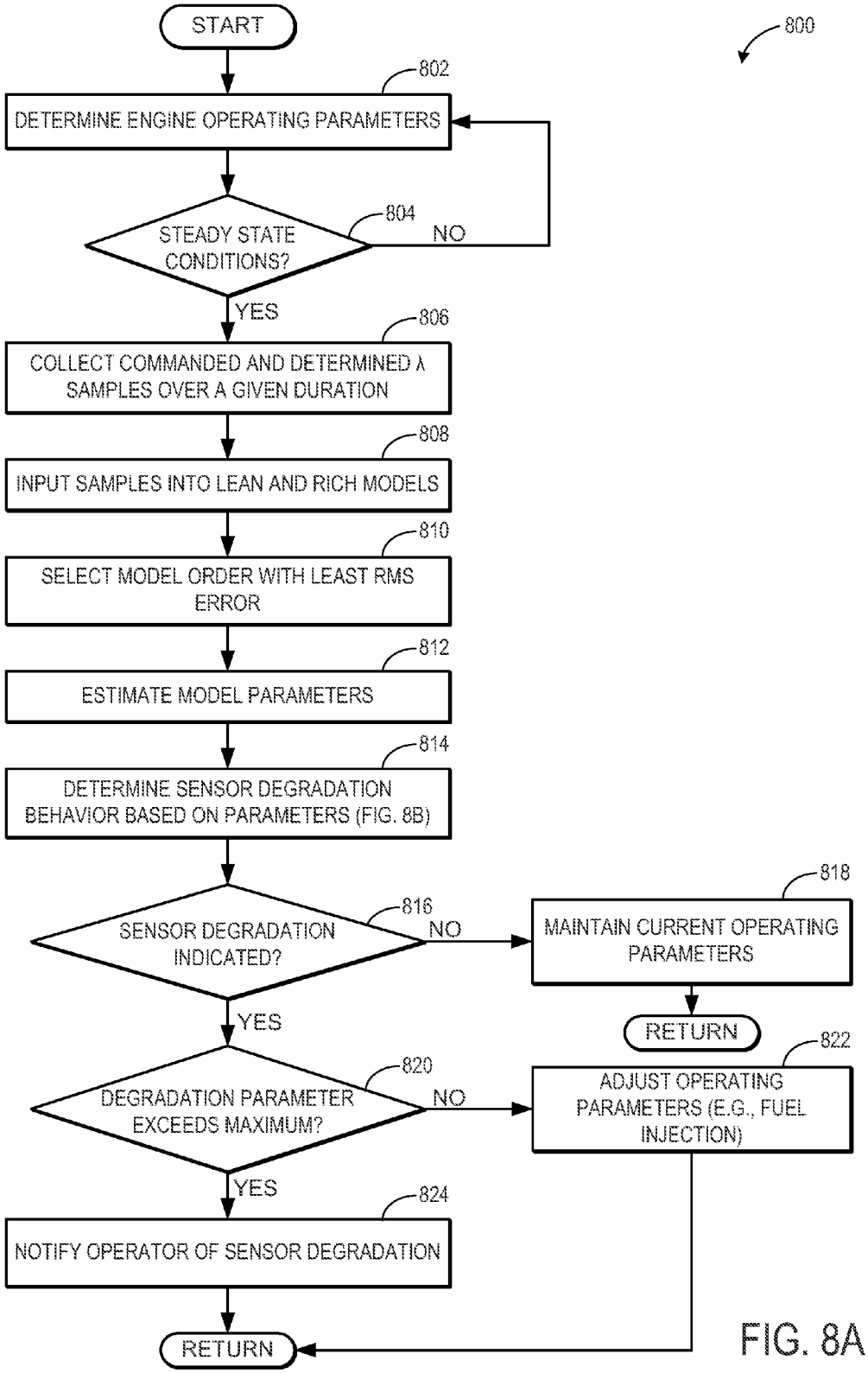
FIGS. 8A and 8B show a method for monitoring an exhaust gas sensor according to an embodiment of the present disclosure.
Figure 8B:
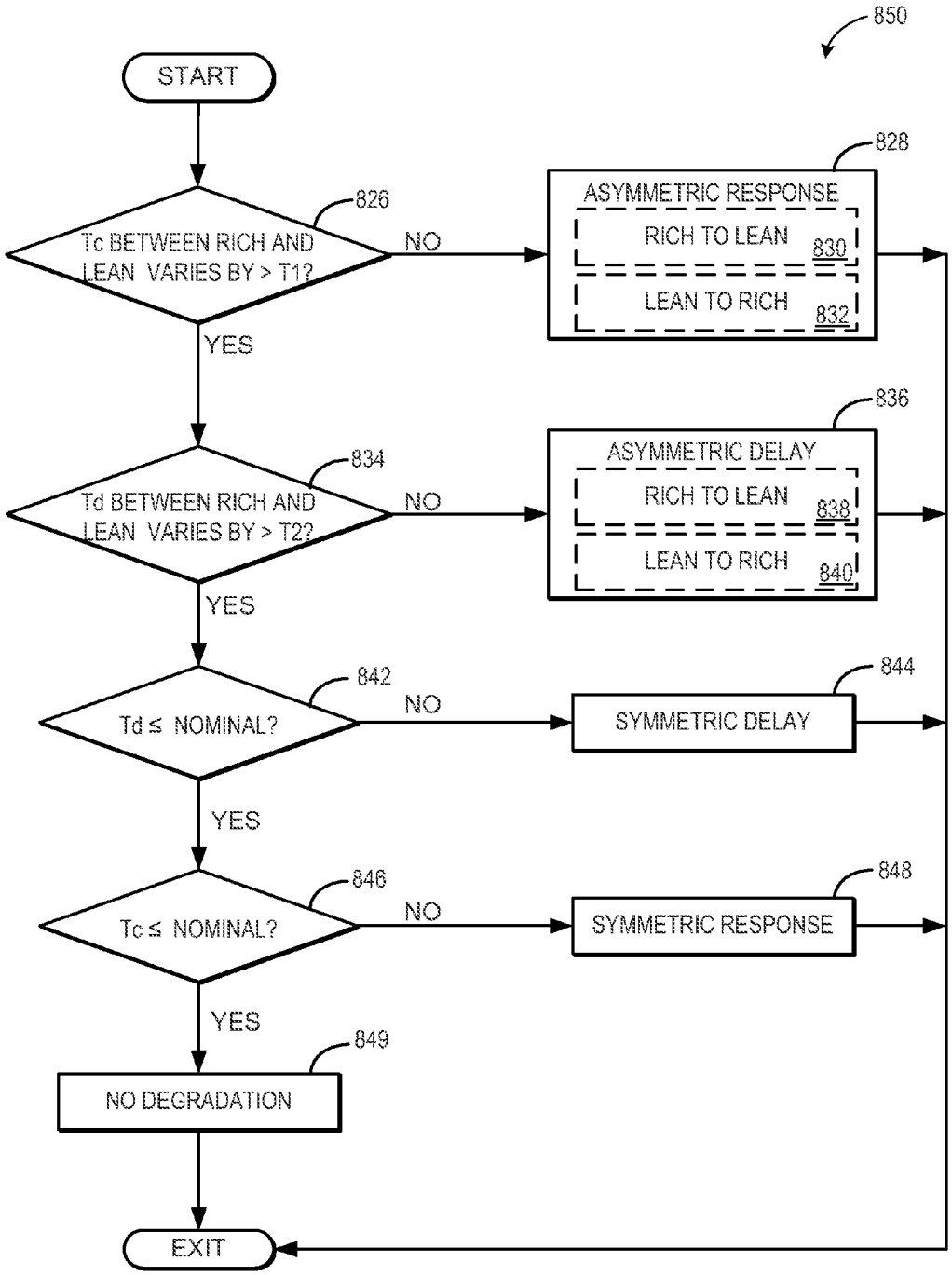

The following description relates to an approach for determining degradation of an exhaust gas sensor. More particularly, the systems and methods described below may be implemented to determine exhaust gas sensor degradation based on recognition of any one of six discrete types of behavior associated with exhaust gas sensor degradation. In one example, model parameters from a rich combustion model and a lean combustion model may be compared to determine sensor degradation. The model parameters may include a time constant, time delay, and static gain of the model. For each of the lean and rich models, the delay order that best fits the data may be selected, and the other model parameters that correspond to the selected delay order may be estimated. For example, during steady state operating conditions, a set of commanded lambda values and measured lambda values may collected and input into the lean and rich models. A least squares algorithm may be applied to the data for the models. The delay order (for each rich and lean model) associated with the least root mean square error may be selected, and the model parameters from each selected model estimated. By comparing the estimated parameters from the two selected models, an asymmetric sensor degradation behavior may be indicated if at least one estimated parameter (e.g., the time constant or time delay) from either the lean model or rich model exceeds the corresponding estimated parameter from the other model by a threshold amount. FIG. 1 illustrates an engine including an exhaust gas sensor and controller. FIGS. 2-7 show example air-fuel ratios collected with exhaust gas sensors exhibiting each of the six discrete sensor degradation behaviors. FIGS. 8A and 8B illustrate example control routines carried out by the controller of FIG. 1 to determine one of the six degradation behaviors illustrated in FIGS. 2-7.

FIG. 1 is a schematic diagram showing one cylinder of multi-cylinder engine 10, which may be included in a propulsion system of a vehicle in which an exhaust gas sensor 126 may be utilized to determine an air fuel ratio of exhaust gas produce by engine 10. The air fuel ratio (along with other operating parameters) may be used for feedback control of engine 10 in various modes of operation. Engine 10 may be controlled at least partially by a control system including controller 12 and by input from a vehicle operator 132 via an input device 130. In this example, input device 130 includes an accelerator pedal and a pedal position sensor 134 for generating a proportional pedal position signal PP. Combustion chamber (i.e., cylinder) 30 of engine 10 may include combustion chamber walls 32 with piston 36 positioned therein. Piston 36 may be coupled to crankshaft 40 so that reciprocating motion of the piston is translated into rotational motion of the crankshaft. Crankshaft 40 may be coupled to at least one drive wheel of a vehicle via an intermediate transmission system. Further, a starter motor may be coupled to crankshaft 40 via a flywheel to enable a starting operation of engine 10.

Combustion chamber 30 may receive intake air from intake manifold 44 via intake passage 42 and may exhaust combustion gases via exhaust passage 48. Intake manifold 44 and exhaust passage 48 can selectively communicate with combustion chamber 30 via respective intake valve 52 and exhaust valve 54. In some embodiments, combustion chamber 30 may include two or more intake valves and/or two or more exhaust valves.

In this example, intake valve 52 and exhaust valves 54 may be controlled by cam actuation via respective cam actuation systems 51 and 53. Cam actuation systems 51 and 53 may each include one or more cams and may utilize one or more of cam profile switching (CPS), variable cam timing (VCT), variable valve timing (VVT) and/or variable valve lift (VVL) systems that may be operated by controller 12 to vary valve operation. The position of intake valve 52 and exhaust valve 54 may be determined by position sensors 55 and 57, respectively. In alternative embodiments, intake valve 52 and/or exhaust valve 54 may be controlled by electric valve actuation. For example, cylinder 30 may alternatively include an intake valve controlled via electric valve actuation and an exhaust valve controlled via cam actuation including CPS and/or VCT systems.

Fuel injector 66 is shown arranged in intake passage 44 in a configuration that provides what is known as port injection of fuel into the intake port upstream of combustion chamber 30. Fuel injector 66 may inject fuel in proportion to the pulse width of signal FPW received from controller 12 via electronic driver 68. Fuel may be delivered to fuel injector 66 by a fuel system (not shown) including a fuel tank, a fuel pump, and a fuel rail. In some embodiments, combustion chamber 30 may alternatively or additionally include a fuel injector coupled directly to combustion chamber 30 for injecting fuel directly therein, in a manner known as direct injection.

Ignition system 88 can provide an ignition spark to combustion chamber 30 via spark plug 92 in response to spark advance signal SA from controller 12, under select operating modes. Though spark ignition components are shown, in some embodiments, combustion chamber 30 or one or more other combustion chambers of engine 10 may be operated in a compression ignition mode, with or without an ignition spark.

Exhaust gas sensor 126 is shown coupled to exhaust passage 48 of exhaust system 50 upstream of emission control device 70. Sensor 126 may be any suitable sensor for providing an indication of exhaust gas air/fuel ratio such as a linear oxygen sensor or UEGO (universal or wide-range exhaust gas oxygen), a two-state oxygen sensor or EGO, a HEGO (heated EGO), a NOx, HC, or CO sensor. In some embodiments, exhaust gas sensor 126 may be a first one of a plurality of exhaust gas sensors positioned in the exhaust system. For example, additional exhaust gas sensors may be positioned downstream of emission control device 70.

Emission control device 70 is shown arranged along exhaust passage 48 downstream of exhaust gas sensor 126. Device 70 may be a three way catalyst (TWC), NOx trap, various other emission control devices, or combinations thereof. In some embodiments, emission control device 70 may be a first one of a plurality of emission control devices positioned in the exhaust system. In some embodiments, during operation of engine 10, emission control device 70 may be periodically reset by operating at least one cylinder of the engine within a particular air/fuel ratio.

Controller 12 is shown in FIG. 1 as a microcomputer, including microprocessor unit 102, input/output ports 104, an electronic storage medium for executable programs and calibration values shown as read only memory chip 106 in this particular example, random access memory 108, keep alive memory 110, and a data bus. Controller 12 may receive various signals from sensors coupled to engine 10, in addition to those signals previously discussed, including measurement of inducted mass air flow (MAF) from mass air flow sensor 120; engine coolant temperature (ECT) from temperature sensor 112 coupled to cooling sleeve 114; a profile ignition pickup signal (PIP) from Hall effect sensor 118 (or other type) coupled to crankshaft 40; throttle position (TP) from a throttle position sensor; and absolute manifold pressure signal, MAP, from sensor 122. Engine speed signal, RPM, may be generated by controller 12 from signal PIP. Manifold pressure signal MAP from a manifold pressure sensor may be used to provide an indication of vacuum, or pressure, in the intake manifold. Note that various combinations of the above sensors may be used, such as a MAF sensor without a MAP sensor, or vice versa. During stoichiometric operation, the MAP sensor can give an indication of engine torque. Further, this sensor, along with the detected engine speed, can provide an estimate of charge (including air) inducted into the cylinder. In one example, sensor 118, which is also used as an engine speed sensor, may produce a predetermined number of equally spaced pulses every revolution of the crankshaft.

Furthermore, at least some of the above described signals may used in the exhaust gas sensor degradation determination method described in further detail below. For example, the inverse of the engine speed may be used to determine delays associated with the injection-intake-compression-expansion-exhaust cycle. As another example, the inverse of the velocity (or the inverse of the MAF signal) may be used to determine a delay associated with travel of the exhaust gas from the exhaust valve 54 to exhaust gas sensor 126. The above described examples along with other use of engine sensor signals may be used to determine the time delay between a change in the commanded air fuel ratio and the exhaust gas sensor response rate.

In some embodiments, exhaust gas sensor degradation determination may be performed in a dedicated controller 140. Dedicated controller 140 may include processing resources 142 to handle signal-processing associated with production, calibration, and validation of the degradation determination of exhaust gas sensor 126. In particular, a sample buffer (e.g., generating approximately 100 samples per second per engine bank) utilized to record the response rate of the exhaust gas sensor may be too large for the processing resources of a powertrain control module (PCM) of the vehicle. Accordingly, dedicated controller 140 may be operatively coupled with controller 12 to perform the exhaust gas sensor degradation determination. Note that dedicated controller 140 may receive engine parameter signals from controller 12 and may send engine control signals and degradation determination information among other communications to controller 12.

Note storage medium read-only memory 106 and/or processing resources 142 can be programmed with computer readable data representing instructions executable by processor 102 and/or dedicated controller 140 for performing the methods described below as well as other variants.

As discussed above, exhaust gas sensor degradation may be determined based on any one, or in some examples each, of six discrete behaviors indicated by delays in the response rate of air/fuel ratio readings generated by an exhaust gas sensor during rich-to-lean transitions and/or lean-to-rich transitions. FIGS. 2-7 each show a graph indicating one of the six discrete types of exhaust gas sensor degradation behaviors. The graphs plot air/fuel ratio (lambda) versus time (in seconds). In each graph, the dotted line indicates a commanded lambda signal that may be sent to engine components (e.g., fuel injectors, cylinder valves, throttle, spark plug, etc.) to generate an air/fuel ratio that progresses through a cycle comprising one or more lean-to-rich transitions and one or more rich-to-lean transitions. In each graph, the dashed line indicates an expected lambda response time of an exhaust gas sensor. In each graph, the solid line indicates a degraded lambda signal that would be produced by a degraded exhaust gas sensor in response to the commanded lambda signal. In each of the graphs, the double arrow lines indicate where the given degradation behavior type differs from the expected lambda signal.

FIG. 2 shows a graph indicating a first type of degradation behavior that may be exhibited by a degraded exhaust gas sensor. This first type of degradation behavior is a symmetric response type that includes slow exhaust gas sensor response to the commanded lambda signal for both rich-to-lean and lean-to-rich modulation. In other words, the degraded lambda signal may start to transition from rich-to-lean and lean-to-rich at the expected times but the response rate may be lower than the expected response rate, which results in reduced lean and rich peak times.

FIG. 3 shows a graph indicating a second type of degradation behavior that may be exhibited by a degraded exhaust gas sensor. The second type of degradation behavior is an asymmetric rich-to-lean response type that includes slow exhaust gas sensor response to the commanded lambda signal for a transition from rich-to-lean air/fuel ratio. This behavior type may start the transition from rich-to-lean at the expected time but the response rate may be lower than the expected response rate, which may result in a reduced lean peak time. This type of behavior may be considered asymmetric because the response of the exhaust gas sensor is slow (or lower than expected) during the transition from rich-to-lean.

FIG. 4 shows a graph indicating a third type of degradation behavior that may be exhibited by a degraded exhaust gas sensor. The third type of behavior is an asymmetric lean-to-rich response type that includes slow exhaust gas sensor response to the commanded lambda signal for a transition from lean-to-rich air/fuel ratio. This behavior type may start the transition from lean-to-rich at the expected time but the response rate may be lower than the expected response rate, which may result in a reduced rich peak time. This type of behavior may be considered asymmetric because the response of the exhaust gas sensor is only slow (or lower than expected) during the transition from lean-to-rich.

FIG. 5 shows a graph indicating a fourth type of degradation behavior that may be exhibited by a degraded exhaust gas sensor. This fourth type of degradation behavior is a symmetric delay type that includes a delayed response to the commanded lambda signal for both rich-to-lean and lean-to-rich modulation. In other words, the degraded lambda signal may start to transition from rich-to-lean and lean-to-rich at times that are delayed from the expected times, but the respective transition may occur at the expected response rate, which results in shifted lean and rich peak times.

FIG. 6 shows a graph indicating a fifth type of degradation behavior that may be exhibited by a degraded exhaust gas sensor. This fifth type of degradation behavior is an asymmetric rich-to-lean delay type that includes a delayed response to the commanded lambda signal from the rich-to-lean air/fuel ratio. In other words, the degraded lambda signal may start to transition from rich-to-lean at a time that is delayed from the expected time, but the transition may occur at the expected response rate, which results in shifted and/or reduced lean peak times. This type of behavior may be considered asymmetric because the response of the exhaust gas sensor is only delayed from the expected start time during a transition from rich-to-lean.

FIG. 7 shows a graph indicating a sixth type of degradation behavior that may be exhibited by a degraded exhaust gas sensor. This sixth type of behavior is an asymmetric lean-to-rich delay type that includes a delayed response to the commanded lambda signal from the lean-to-rich air/fuel ratio. In other words, the degraded lambda signal may start to transition from lean-to-rich at a time that is delayed from the expected time, but the transition may occur at the expected response rate, which results in shifted and/or reduced rich peak times. This type of behavior may be considered asymmetric because the response of the exhaust gas sensor is only delayed from the expected start time during a transition from lean-to-rich.

It will be appreciated that a degraded exhaust gas sensor may exhibit a combination of two or more of the above described degradation behaviors. For example, a degraded exhaust gas sensor may exhibit an asymmetric rich-to-lean response degradation behavior (i.e., FIG. 3) as well as an asymmetric rich-to-lean response degradation behavior (i.e., FIG. 6).

Turning now to FIGS. 8A and 8B, an example method for determining an exhaust gas sensor degradation behavior is depicted according to an embodiment of the present disclosure. FIGS. 8A and 8B include a method 800 for monitoring an exhaust gas sensor coupled in an engine exhaust. Method 800 may be carried out by a control system of a vehicle, such as controller 12 and/or dedicated controller 140, to monitor a sensor, such as exhaust gas sensor 126.

Referring specifically to FIG. 8A, at 802, method 800 includes determining engine operating parameters. Engine operating parameters may be determined based on feedback from various engine sensors, and may include engine speed, load, air/fuel ratio, temperature, etc. Further, engine operating parameters may be determined over a given duration, e.g., 10 seconds, in order to determine whether certain engine operating conditions are changing, or whether the engine is operating under steady-state conditions. As such, method 800 includes, at 804, determining if the engine is operating in steady-state conditions based on the determined engine operating parameters. Steady-state conditions may be determined based on certain operating parameters changing less than a threshold amount during the given duration. In one example, steady-state conditions may be indicated if the engine is operating at idle, or if engine speed varies by less than 20%, engine load varies by less than 30%, and/or engine air/fuel ratio varies by less than 0.15. In some embodiments, steady-state conditions may also include engine temperature varying by less than a threshold amount, or engine temperature being above a threshold amount. This may avoid monitoring the sensor during cold engine operation, when the sensor may not be heated and thus may not be producing accurate output.

If it is determined at 804 that the engine is not operating in steady-state conditions, method 800 returns to 802 to continue to determine engine operating parameters. If steady state conditions are determined, method 800 proceeds to 806 to collect commanded and determined lambda samples over a given duration, and store the sample values in a memory of the controller. The commanded lambda values may be values set by the controller for desired air/fuel ratio based on engine speed, load, feedback from upstream and downstream exhaust gas sensors, etc. The determined lambda values may be the collected output from the monitored exhaust gas sensor. For example, 100 commanded lambda samples and corresponding determined lambda samples may be collected over a ten second duration. Multiple sets of lambda samples may be collected, with or without intervening engine operation between sets.

At 808, method 800 comprises inputting the collected samples into lean and rich operation models. Due to the potential presence of asymmetric sensor behavior, operation may be split into two modes (lean and rich), with two separate models specific to each mode. In one embodiment, the models may include a first order plus time delay model, represented by the following equation for a lean operation model:

$$G_l(z^{-1}) = \frac{a_l z^{-1}}{1 + b_l z^{-1}} z^{-d_l}$$

And for a rich operation model:

$$G_r(z^{-1}) = \frac{a_r z^{-1}}{1 + b_r z^{-1}} z^{-d_r}$$

Wherein, for each of the rich and lean models, the model parameters $a_l$ and $a_r$ represent the static gain or system response of the model, $b_l$ and $b_r$ represent the time constant, and $d_l$ and $d_r$ represent the time delay. These model parameters can be estimated based on the commanded lambda values (e.g., input into the models) and determined lambda values (e.g., the output of the models). To simplify this, the rich and lean models may be combined into a single equation. First, based on the first order plus time delay models above, the difference equations for each operation mode are:

$$y(k)+b_l \cdot y(k-1)=a_l \cdot u(k-d_l-1)$$

$$y(k)+b_r \cdot y(k-1)=a_r \cdot u(k-d_r-1)$$

As the input (y) and output (u) of the models are the commanded and determined lambda values, respectively, the input and output for each model may be represented by:

$$y_l(k)=\lambda(k) \cdot y(k);\ u_l(k)=\lambda(k) \cdot u(k)$$

$$y_r(k)=(1-\lambda(k)) \cdot y(k);\ u_r(k)=(1-\lambda(k)) \cdot u(k)$$

These equations can then be combined into a single equation:

$$y(k)+b_l \cdot y_l(k-1)+b_r \cdot y_r(k-1)=a_l \cdot u_l(k-d_l-1)+a_r \cdot u_r(k-d_r-1)$$

Next, the model parameters may be estimated. To do this, a least squares algorithm is applied to the data in order to identify the coefficients of the model, for a plurality of model orders for the delay. The maximum possible order for the delay may be determined at 810 based upon the root mean square (RMS) error associated with the least squares of each model. For example, the model order associated with the smallest RMS error may be selected. The model parameters determined at 812 may then be the estimated model parameters determined by the least squares algorithm for that model order.

At 814, sensor degradation may be determined based on the model parameters for each of the lean and rich models. To determine if the sensor is exhibiting degradation, and which type, the parameters from the models may be compared to each other, and if any of the parameters between the models deviate, degradation may be indicated. This determination may be carried out using the method described below with reference to FIG. 8B.

FIG. 8B is a flow chart illustrating a method 850 for determining sensor degradation behavior based on the model parameters. Method 850 may be carried out by the controller as part of method 800, for example during the sensor degradation determination at 814. Method 850 includes, at 826, comparing the time constants Tc for each of the rich and lean models, and if the time constants vary by an amount greater than a threshold T1, indicating degradation. The threshold T1 may be a suitable threshold that balances sensitivity of the determination with normal sensor variation, such as 20%. In some embodiments, the threshold may be fixed, while in other embodiments, the threshold may vary based on operating conditions such as engine speed when the lambda samples were collected, the magnitude of the estimated time constants, etc.

Thus, if at 826 it is determined that the time constants do not differ by less than the threshold amount, method 850 proceeds to 828 to indicate an asymmetric response degradation. If the time constant estimated from the lean model is higher than the time constant from the rich model, a rich to lean response behavior is indicated at 830, and if the rich time constant is higher than the lean time constant, a lean to rich behavior is indicated at 832. The time constant indicates how quickly the sensor responds to a commanded change in lambda, e.g., the amount of time from when the sensor begins to output a change in the lambda values until the commanded lambda value is reached. If the sensor exhibits a rich to lean response degradation, the time constant for the lean model will be higher than the time constant for the rich model, as it takes the sensor a longer amount of time to respond to a lean command than to a rich command.

If the time constants do vary by less than the threshold amount, method 850 proceeds to 834 to determine if the time delays Td of the rich and lean models vary by less than a second threshold amount, T2. Similar to the first threshold, the second threshold may be selected in order to balance sensitivity of the detection with normal sensor variation, and be a set amount such as 20%, or may change depending on operating conditions. If the time delays do not vary by less than the second threshold, method 850 proceeds to 836 to indicate an asymmetric delay degradation. The asymmetric delay may be a rich to lean delay at 838, if the time delay from the lean model is higher than the time delay from the rich model, or may be lean to rich delay at 840 if the rich delay is higher than the lean delay.

If the time delays do vary by less than the second threshold at 834, a symmetric sensor condition is indicated. The model parameters as determined by method 800 may not distinguish symmetric sensor behavior types from each other. Thus, method 850 proceeds to 842 to determine if a determined sensor time delay is less than or equal to a nominal time delay. The nominal sensor time delay is the expected delay in sensor response to a commanded air/fuel ratio change based on the delay from when the fuel is injected, combusted, and the exhaust travels from the combustion chamber to the exhaust sensor. The determined time delay may be when the sensor actually outputs a signal indicating the changed air/fuel ratio. If the time delay is not less than or equal to the nominal time delay, method 850 proceeds to 844 to indicate a symmetric delay.

If the time delay is less than or equal to the nominal time delay, method 850 proceeds to 846 to determine if a determined sensor time constant is less than or equal to a nominal time constant. The nominal time constant may be the time constant indicating how quickly the sensor responds to a commanded change in lambda, and may be determined off-line based on non-degraded sensor function. If the determined time constant is greater than the nominal time constant, it indicates a slow response rate, and thus at 848, if the time constant is not less than or equal to the nominal time constant, a symmetric response degradation behavior is indicated.

If the time constant is less than or equal to the nominal time constant, method 800 includes indicating no degradation at 849. No degradation is indicated due to the model parameters indicating a symmetric behavior of the sensor, and both the sensor time constant and delay being similar to the nominal time constant and delay. Upon indicating a sensor degradation behavior, or no degradation, method 850 exits.

Thus, method 850 described with respect to FIG. 8B provides for determining a sensor degradation behavior type based on the estimated model parameters, and further based on determined sensor time constant and time delay. Once the sensor behavior has been determined, additional action may be taken based on the type of degradation identified. Referring back to FIG. 8A, at 816, method 800 comprises determining if sensor degradation is indicated. If sensor degradation is not indicated (e.g., no degradation is indicated by method 850), method 800 proceeds to 818 to maintain current operating parameters. If sensor degradation is indicated, method 800 proceeds to 820 to determine the whether the sensor degradation behavior exceeds a maximum value. As described above, sensor degradation may be indicated based on the difference between the estimated model parameters for the rich and lean operation models. The parameter that indicates degradation (e.g., the time delay or time constant) may be analyzed to determine the extent of the degradation. For example, a difference between the time delays or time constants of the rich and lean models that exceeds a threshold amount may indicate an asymmetric delay degradation behavior. If the difference is greater than a sufficient amount, for example if the difference is 30% or more, the degradation behavior may exceed the maximum limit. If the degradation behavior exceeds the maximum value, this may indicate the sensor is damaged or otherwise non-functional and as such method 800 proceeds to 824 to notify an operator of the vehicle of the sensor degradation, for example by activating a malfunction indication light. If the degradation behavior does not exceed the maximum value, it may indicate that the sensor is still functional. However, to ensure adequate engine control to maintain engine emissions and fuel economy at a desired level, one or more engine operating parameters may be adjusted at 822, if desired. This may include adjusting fuel injection amount and/or timing, and may include adjusting control routines that are based on feedback from the degraded sensor to compensate for the identified degradation.

Thus, the methods described above with respect to FIGS. 8A and 8B provide for determining asymmetric sensor degradation based on a difference between estimated model parameters from a lean operation model and a rich operation model. The inputs into the models may be commanded lambda values, while the outputs from the models may be the exhaust gas sensor output, or the determined lambda values. A least squares algorithm may be applied to each input/output data set for each model, and the delay order associated with the least amount of RMS error selected. Based on the selected delay order, the model parameters may be estimated.

These methods allow for sensor degradation monitoring during steady state operating conditions, for example during idle operation or when engine speed varies by less than a threshold amount, such as 20%. In doing so, the sensor may be monitored during normal engine operation, avoiding operation under conditions that may be undesired and lead to increased emissions and/or reduced fuel economy. However, in some embodiments, the engine may purposely be operated rich or lean and the sensor monitored during these operation periods in order to increase the sensitivity of the detection and/or validate the models.

It will be appreciated that the configurations and methods disclosed herein are exemplary in nature, and that these specific embodiments are not to be considered in a limiting sense, because numerous variations are possible. For example, the above technology can be applied to V-6, I-4, I-6, V-12, opposed 4, and other engine types. The subject matter of the present disclosure includes all novel and non-obvious combinations and sub-combinations of the various systems and configurations, and other features, functions, and/or properties disclosed herein.

The following claims particularly point out certain combinations and sub-combinations regarded as novel and non-obvious. These claims may refer to "an" element or "a first" element or the equivalent thereof. Such claims should be understood to include incorporation of one or more such elements, neither requiring nor excluding two or more such elements. Other combinations and sub-combinations of the disclosed features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

The invention claimed is:

1. A method of monitoring an exhaust gas sensor coupled in an engine exhaust, comprising:

indicating exhaust gas sensor degradation based on a difference between a first set of estimated parameters of a rich operation model and a second set of estimated parameters of a lean operation model, the estimated parameters based on commanded lambda and determined lambda values collected during selected operating conditions.

2. The method of claim 1, wherein the rich and lean operation models comprise first order plus time delay transfer functions specific to each operation mode.

3. The method of claim 1, wherein the estimated parameters include a system response, time delay, and time constant.

4. The method of claim 3, wherein the system response, time delay, and time constant for each of the rich and lean models are estimated based on a delay order associated with a least amount of root mean square error.

5. The method of claim 4, indicating an asymmetric response degradation behavior if the estimated time constants for the rich and lean models vary by a threshold amount.

6. The method of claim 4, indicating an asymmetric delay degradation behavior if the estimated delays for the rich and lean models vary by a threshold amount.

7. The method of claim 1, wherein the selected operating parameters include steady state operating conditions.

8. The method of claim 1, further comprising adjusting a fuel injection amount and/or timing based on the indicated degradation.

9. A system for a vehicle, comprising:

an engine including a fuel injection system;

an exhaust gas sensor coupled in an exhaust system of the engine; and a controller including instructions executable to:

indicate exhaust gas sensor degradation based on a difference between a first set of estimated parameters of a rich operation model and a second set of estimated parameters of a lean operation model, the estimated parameters based on commanded lambda and determined lambda values collected during selected operating conditions; and adjust an amount and/or timing of fuel injection based on the indicated sensor degradation.

10. The system of claim 9, wherein the first and second sets of estimated parameters each include a system response, time delay, and time constant.

11. The system of claim 10, wherein the instructions are further executable to indicate an asymmetric response degradation behavior if a difference between the estimated time constants for the rich and lean models exceeds a threshold amount.

12. The system of claim 10, wherein the instructions are further executable to indicate an asymmetric delay degradation behavior if a difference between the estimated time delays for the rich and lean models exceeds a threshold amount.

13. The system of claim 9, wherein the selected operating conditions include steady state operating conditions.

14. A method of monitoring an oxygen sensor coupled in an engine exhaust, comprising:

indicating an asymmetric delay sensor degradation if a first estimated time delay of a rich operation model and a second estimated time delay of a lean operation model differ by a first threshold amount; and indicating an asymmetric response sensor degradation if a first estimated time constant of a rich operation model and a second estimated time constant of a lean operation model differ by a second threshold amount.

15. The method of claim 14, wherein the estimated time delay and estimated time constant of each model are selected based on root mean square (RMS) error associated with each operation model.

16. The method of claim 15, wherein the RMS error associated with each operation model is based on a least squares algorithm of commanded lambda and determined lambda values collected during steady state operating conditions.

17. The method of claim 14, wherein the lean and rich operation models are first order plus time delay models.

18. The method of claim 14, wherein if the estimated time delay of the lean operation model exceeds the estimated time delay of the rich operation model, indicating a rich to lean delay sensor degradation behavior, and if the estimated time delay of the rich operation model exceeds the estimated time delay of the lean operation model, indicating a lean to rich delay sensor degradation behavior.

19. The method of claim 14, wherein if the estimated time constant of the lean operation model exceeds the estimated time constant of the rich operation model, indicating a rich to lean delay response degradation behavior, and if the estimated time constant of the rich operation model exceeds the estimated time constant of the lean operation model, indicating a lean to rich response sensor degradation behavior.

20. The method of claim 14, further comprising indicating a symmetric sensor degradation behavior or no sensor degradation if the estimated time delays differ by less than the first threshold amount and the estimated time constants differ by less than the second threshold amount.

* * * * *